US009646751B2

(12) United States Patent
Yoshida et al.

(10) Patent No.: US 9,646,751 B2
(45) Date of Patent: May 9, 2017

(54) ARCUATE MAGNET HAVING POLAR-ANISOTROPIC ORIENTATION, AND METHOD AND MOLDING DIE FOR PRODUCING IT

(75) Inventors: Takeshi Yoshida, Kumagaya (JP); Mikio Shindoh, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 571 days.

(21) Appl. No.: 13/976,254

(22) PCT Filed: Dec. 21, 2011

(86) PCT No.: PCT/JP2011/079737
§ 371 (c)(1),
(2), (4) Date: Jun. 26, 2013

(87) PCT Pub. No.: WO2012/090841
PCT Pub. Date: Jul. 5, 2012

(65) Prior Publication Data

US 2013/0278367 A1 Oct. 24, 2013

(30) Foreign Application Priority Data

Dec. 28, 2010 (JP) ..... 2010-293954
Jul. 29, 2011 (JP) ..... 2011-166721

(51) Int. Cl.
*H01F 41/02* (2006.01)
*B22F 3/03* (2006.01)
(Continued)

(52) U.S. Cl.
CPC ..... *H01F 7/02* (2013.01); *B30B 11/027* (2013.01); *H01F 41/0273* (2013.01); *B22F 3/02* (2013.01);
(Continued)

(58) Field of Classification Search
CPC ..... H01F 41/0273; H01F 7/02; B22F 3/02
(Continued)

(56) References Cited

U.S. PATENT DOCUMENTS 4,150,927 A 4/1979 Steingroever
4,981,532 A * 1/1991 Takeshita ..... B22F 9/023 148/302
(Continued)

FOREIGN PATENT DOCUMENTS

DE 26 29 990 A1 1/1978
JP 62-008506 A 1/1987
(Continued)

OTHER PUBLICATIONS

International Search Report for PCT/JP2011/079737, dated Apr. 3, 2012.
(Continued)

*Primary Examiner* — Jessee Roe
*Assistant Examiner* — Jeremy Jones
(74) *Attorney, Agent, or Firm* — Sughrue Mion, PLLC

(57) ABSTRACT

A die apparatus for molding an arcuate magnet having polar-anisotropic orientation in a magnetic field, which comprises a die made of non-magnetic cemented carbide, which is arranged in a parallel magnetic field generated by a pair of opposing magnetic field coils; an arcuate-cross-sectional cavity having an inner arcuate wall, an outer arcuate wall and two side walls, which is disposed in the die; a central ferromagnetic body arranged on the side of the outer arcuate wall of the cavity; and a pair of side ferromagnetic bodies symmetrically arranged on both side wall sides of the cavity; the cavity being arranged such that its radial direction at a circumferential center thereof is identical with the direction of the parallel magnetic field; the width of the central ferromagnetic body being smaller than
(Continued)

the width of the cavity in a direction perpendicular to the parallel magnetic field; and a pair of the side ferromagnetic bodies being arranged such that the cavity is positioned in a region sandwiched by a pair of the side ferromagnetic bodies.

19 Claims, 8 Drawing Sheets

(51) Int. Cl.
*H01F 7/02* (2006.01)
*B30B 11/02* (2006.01)
*B22F 3/02* (2006.01)

(52) U.S. Cl.
CPC ..... *B22F 3/03* (2013.01); *B22F 2998/10* (2013.01); *B22F 2999/00* (2013.01); *C22C 2202/02* (2013.01)

(58) Field of Classification Search
USPC ..... 264/429; 419/66
See application file for complete search history.

(56) References Cited

U.S. PATENT DOCUMENTS

| | | | | |
|---|---|---|---|---|
| 5,204,569 | A * | 4/1993 | Hino | H01F 13/003 310/154.28 |
| 5,273,571 | A * | 12/1993 | Mirchandani | B21D 37/01 428/546 |
| 6,992,553 | B2 | 1/2006 | Masuzawa et al. | |
| 7,202,585 | B2 | 4/2007 | Ohata et al. | |
| 2003/0117032 | A1 | 6/2003 | Komuro et al. | |
| 2005/0076973 | A1 | 4/2005 | Masuzawa et al. | |
| 2005/0093390 | A1 | 5/2005 | Komuro et al. | |
| 2006/0017343 | A1 | 1/2006 | Ohata et al. | |

FOREIGN PATENT DOCUMENTS

| | | | | |
|---|---|---|---|---|
| JP | 05-129127 | A | | 5/1993 |
| JP | 05-168201 | A | | 7/1993 |
| JP | 05168201 | A | * | 7/1993 |
| JP | 2002-134314 | A | | 5/2002 |
| JP | 2003-017309 | A | | 1/2003 |
| JP | 2003-199274 | A | | 7/2003 |
| JP | 2005-044820 | A | | 2/2005 |
| JP | 2005-286081 | A | | 10/2005 |
| JP | 2005-287181 | A | | 10/2005 |
| JP | 2006-042414 | A | | 2/2006 |

OTHER PUBLICATIONS

Communication dated Sep. 29, 2015, issued by the Japan Patent Office in corresponding Japanese Application No. 2012-550894.
Communication dated Oct. 1, 2015, issued by the German Patent Office in corresponding German Application No. 11 2011 104 619.7.

* cited by examiner

ARCUATE MAGNET HAVING POLAR-ANISOTROPIC ORIENTATION, AND METHOD AND MOLDING DIE FOR PRODUCING IT

CROSS REFERENCE TO RELATED APPLICATIONS

This application is a National Stage of International Application No. PCT/JP2011/079737 filed Dec. 21, 2011 (claiming priority based on Japanese Patent Application Nos. 2010-293954 filed Dec. 28, 2010 and 2011-166721 filed Jul. 29, 2011), the contents of which are incorporated herein by reference in their entirety.

FIELD OF THE INVENTION

The present invention relates to an arcuate magnet having polar-anisotropic orientation, and a method and a die apparatus for producing it.

BACKGROUND OF THE INVENTION

Permanent magnets made substantially of R-TM-B are widely used because of inexpensiveness and high magnetic properties. Because R-TM-B materials have high mechanical strength with little brittleness in addition to excellent magnetic properties, they are less subject to cracking, etc. even when large internal stress is generated by sintering shrinkage. Accordingly, they are suitable for ring magnets having radial anisotropy or multi-polar-anisotropic orientation, largely contributing to providing motors with higher power and smaller sizes.

Because polar-anisotropic ring magnets have surface magnetic flux density waves having higher peaks and closer to a sinusoidal wave after magnetization than those of radial-anisotropic magnets, the polar-anisotropic ring magnets are used as rotors to provide motors with small cogging torque. However, because the polar-anisotropic ring magnets have different orientation directions from portion to portion, cracking called "orientation cracking" occurs easily during sintering. Particularly in the case of large ring magnets, green bodies are likely damaged in production processes, resulting in high risks of cracking.

Instead of using a ring-shaped magnet, a rotor is generally formed by attaching arcuate magnets to a cylindrical yoke. For example, JP 2005-286081 A discloses a method for producing an arcuate magnet having a radial orientation suitable for rotors. However, because arcuate magnets having radial orientation have surface magnetic flux density waves in a trapezoidal form, they cannot be used for rotors needing a sinusoidal waveform. Accordingly, the development of new technologies for producing arcuate magnets having polar-anisotropic orientation has been desired.

JP 2003-199274 A discloses a rotor having a low cogging torque, which comprises arcuate magnets having polar-anisotropic orientation. However, JP 2003-199274 A does not specifically describe a method for producing an arcuate magnet having polar-anisotropic orientation.

A ring magnet having polar-anisotropic orientation can be produced by using, for example, a die apparatus 300 shown in FIG. 10 (corresponding to FIG. 3 of JP 2003-17309 A), which comprises a cavity 330 defined by a core 320 and a die 340 with a spacer 310 on the inner surface, magnetic powder charged into the cavity 330 being oriented to have multi-pole orientation by a magnetic field generated from coils 360 disposed in grooves 350 on the inner surface of the die apparatus 340, to which pulse current is applied. A polar-anisotropic ring magnet produced by such method has a surface magnetic flux density distribution in a circumferential direction, which is close to a sinusoidal waveform, with radial orientation at magnetic poles and circumferential orientation between adjacent magnetic poles (see, for example, JP 2005-44820 A).

To provide an arcuate magnet with such polar-anisotropic orientation, the arcuate magnet should be oriented perpendicularly at circumferential end surfaces, and radially at a circumferential center of its outer arcuate surface, so that a ring magnet obtained by assembling them can have a waveform closer to a sinusoidal wave.

A ring magnet having polar-anisotropic orientation can be molded in a pulse magnetic field generated from coils arranged at even intervals corresponding to the number of magnetic poles as described above. In the case of arcuate magnets having polar-anisotropic orientation, however, it is difficult to adjust the arrangement of magnetic-field-generating coils and voltage applied thereto in a die apparatus having such structure, resulting in difficulty in obtaining ideal arcuate magnets having polar-anisotropic orientation. Accordingly, as in the case of molding block-shaped magnets, a magnetic body should be properly arranged in a parallel magnetic field with its direction changed, to produce an arcuate magnet having polar-anisotropic orientation.

JP 2005-287181 A discloses an arcuate magnet having orientation converged at a center on the outer arcuate side, describing that it provides a rotor with reduced cogging torque. However, because the arcuate magnet described in JP 2005-287181 A has orientation different from ideal polar-anisotropic orientation, the assembling of pluralities of the arcuate magnets in a ring shape would not provide a ring magnet having polar-anisotropic orientation, leaving room for improvement in the reduction of cogging torque.

JP 2002-134314 A discloses a method for producing an arcuate magnet having an arcuate cross section, easy-magnetization axes of magnetic powder in the cross section being converged form the outer surface and both end surfaces toward a center region of the inner surface in projected curves. However, an arcuate magnet produced by the method described in JP 2002-134314 A has a functioning surface on the inner surface, not on the outer surface.

When rotors with large magnets having polar-anisotropic orientation are produced, there is now only a method of assembling parallel-oriented magnet segments in a ring shape having polar-anisotropic orientation. Thus, it is desired to develop a method for producing a sintered arcuate R-TM-B magnet having polar-anisotropic orientation.

OBJECT OF THE INVENTION

Accordingly, an object of the present invention is to provide an arcuate magnet, particularly a sintered arcuate R-TM-B magnet, having the same magnetic field orientation as that of one magnetic pole of a polar-anisotropic ring magnet, a method for producing it, and a die apparatus for producing it.

SUMMARY OF THE INVENTION

As a result of intensive research in view of the above object, the inventors have found that an arcuate magnet having polar-anisotropic orientation is produced by a die apparatus comprising an arcuate-cross-sectional cavity, a central ferromagnetic body arranged on the side of the outer arcuate surface of the cavity with a gap therebetween, and a pair of side ferromagnetic bodies arranged on both sides of the cavity. The present invention has been completed based on such finding.

Thus, the die apparatus of the present invention for molding an arcuate magnet having polar-anisotropic orientation in a magnetic field comprises a die made of non-magnetic cemented carbide, which is arranged in a parallel magnetic field generated by a pair of opposing magnetic field coils;

an arcuate-cross-sectional cavity having an inner arcuate wall, an outer arcuate wall and two side walls, which is disposed in the die;

a central ferromagnetic body arranged on the side of the outer arcuate wall of the cavity with distance from the cavity; and a pair of side ferromagnetic bodies symmetrically arranged on both side wall sides of the cavity with distance from the cavity;

the cavity being arranged such that its radial direction at a circumferential center thereof is identical with the direction of the parallel magnetic field;

the width of the central ferromagnetic body being smaller than the width of the cavity in a direction perpendicular to the parallel magnetic field, when viewed from above; and a pair of the side ferromagnetic bodies being arranged such that the cavity is positioned in a region sandwiched by a pair of the side ferromagnetic bodies.

The central ferromagnetic body is preferably arranged on a radial-direction line passing through a circumferential middle point of the cavity, having a symmetrical shape with respect to the radial-direction line, when viewed from above.

It is preferable that the central ferromagnetic body has a symmetrical shape with respect to a plane, which passes through a middle point of the central ferromagnetic body in the direction of the magnetic field and is perpendicular to the direction of the magnetic field, and that another cavity and another pair of side ferromagnetic bodies are arranged symmetrically with respect to the plane.

The central ferromagnetic body and/or the side ferromagnetic bodies are preferably rectangular when viewed from above.

An angle between each side wall surface of the cavity and a surface of each of the side ferromagnetic bodies opposing the side wall is more than 0°.

The method of the present invention for producing an arcuate magnet having polar-anisotropic orientation uses a die apparatus comprising a die made of non-magnetic cemented carbide, which is arranged in a parallel magnetic field generated by a pair of opposing magnetic field coils;

an arcuate-cross-sectional cavity having an inner arcuate wall, an outer arcuate wall and two side walls, which is disposed in the die;

a central ferromagnetic body arranged on the side of the outer arcuate wall of the cavity with distance from the cavity; and a pair of side ferromagnetic bodies symmetrically arranged on both side wall sides of the cavity with distance from the cavity;

the cavity being arranged such that its radial direction at a circumferential center thereof is identical with the direction of the parallel magnetic field;

the width of the central ferromagnetic body being smaller than the width of the cavity in a direction perpendicular to the parallel magnetic field, when viewed from above; and a pair of the side ferromagnetic bodies being arranged such that the cavity is positioned in a region sandwiched by a pair of the side ferromagnetic bodies;

magnetic powder charged into the cavity being compression-molded in the parallel magnetic field.

The magnetic powder is preferably made substantially of R-TM-B, wherein R is at least one of rare earth elements including Y, and TM is at least one of transition metals.

The arcuate magnet of the present invention having polar-anisotropic orientation is produced by the above method.

BRIEF DESCRIPTION OF THE DRAWINGS

FIG. 1(*b*) is a cross-sectional view schematically showing the orientation direction of magnetic powder in the arcuate magnet of the present invention.

FIG. 2(*b*) is a cross-sectional view taken along the line A-A in FIG. 2(*a*).

FIG. 2(*c*) is a cross-sectional view taken along the line B-B in FIG. 2(*a*).

FIG. 3(*b*) is a schematic view showing another example of cross-sectional shapes of the cavity.

FIG. 5(*b*) is a schematic view showing another example of the positional relations between a cavity and a side ferromagnetic body.

FIG. 6(*b*) is a schematic view showing another example of parallel magnetic fields applied in the die apparatus.

FIG. 7(*b*) is a schematic view showing another example of the relations between opposing surfaces of a cavity and a side ferromagnetic body.

DESCRIPTION OF THE PREFERRED EMBODIMENTS

[1] Arcuate Magnet Having Polar-Anisotropic Orientation

Figure 1A:
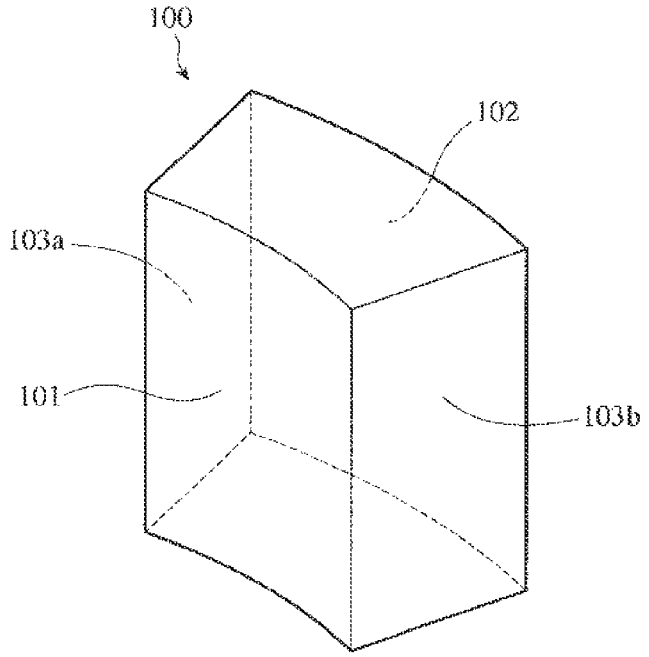
FIG. 1(*a*) is a perspective view showing the arcuate magnet of the present invention.
Figure 1B:
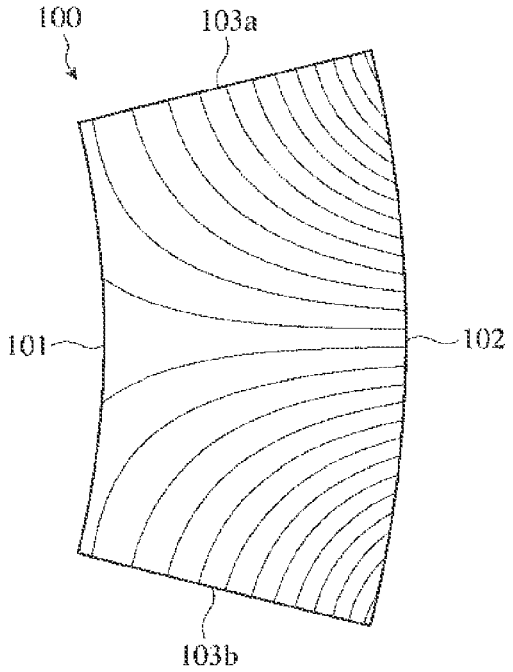
Figure 11:
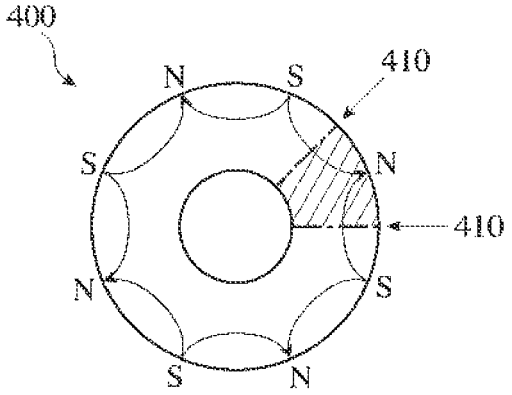
FIG. 11 is a schematic view showing a ring magnet having polar-anisotropic orientation.

The arcuate magnet of the present invention having polar-anisotropic orientation is in a shape of an arcuate-cross-sectional column having a width in a radial direction as shown in FIG. 1(*a*), and the orientation of magnetic powder in the cross section of the arcuate magnet 100 is in a in a circumferential direction at circumferential end surfaces 103*a*, 103*b* (perpendicular to the end surfaces 103*a*, 103*b*), and in a radial direction at a circumferential center of an outer arcuate surface 102, as shown in FIG. 1(*b*). The assembling of the arcuate magnets 100 with such orientation to a ring shape can provide a ring magnet having magnetic powder oriented in a circumferential direction between magnetic poles, which has the same structure as that of the polar-anisotropic ring magnet 400 shown in FIG. 11. Namely, the arcuate magnet of the present invention having polar-anisotropic orientation has a structure obtained by cutting the ring magnet 400 along lines 410, 410 between its magnetic poles (shown by hatching in FIG. 11).

The arcuate magnet of the present invention having polar-anisotropic orientation is preferably made substantially of R-TM-B. R is at least one of rare earth elements including Y, preferably containing at least one of Nd, Dy and Pr indispensably. TM is at least one of transition metals, preferably Fe. The arcuate magnet made of R-TM-B preferably comprises a composition comprising 24-34% by mass of R, and 0.6-1.8% by mass of B, the balance being Fe. Less than 24% by mass of the R content provides low residual magnetic flux density Br and coercivity iHc. When the R content is more than 34%, rare-earth-rich phase regions increase in the sintered body, resulting in a low residual magnetic flux density Br, and low corrosion resistance because such regions are coarse. When the B content is less than 0.6% by mass, an $R_2Fe_{14}B$ phase (main phase) is not sufficiently formed, but an $R_2Fe_{17}$ phase having soft-magnetic properties are formed, resulting in low coercivity. On the other hand, when the B content is more than 1.8% by mass, a B-rich phase (non-magnetic phase) increases, resulting in a low residual magnetic flux density Br. Part of Fe may be substituted by Co, and about 3% or less by mass of elements such as Al, Si, Cu, Ga, Nb, Mo, W, etc. may be contained.

[2] Die Apparatus (1) Overall Structure

Figure 2A:
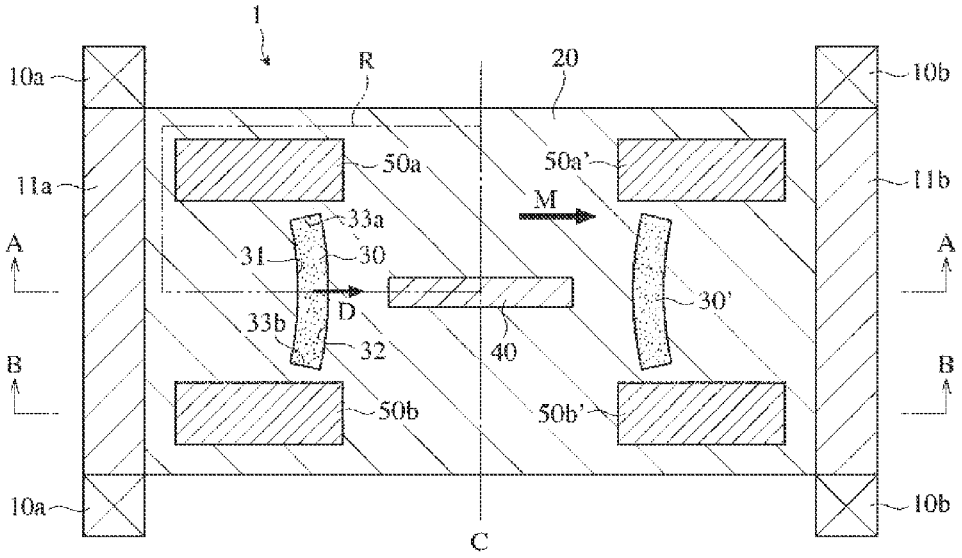
FIG. 2(*a*) is a plan view schematically showing the structure of the die apparatus of the present invention.
Figure 2B:
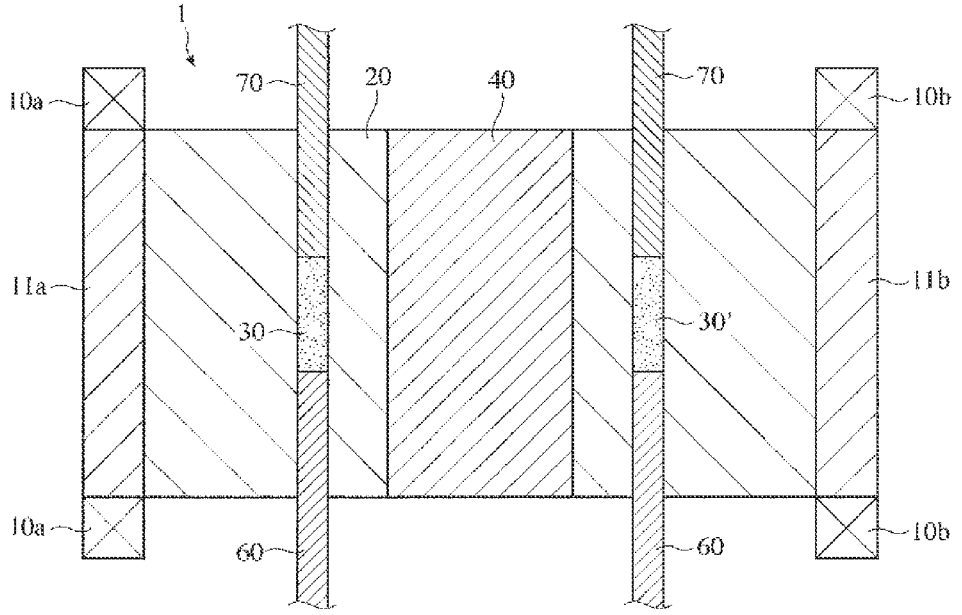
Figure 2C:
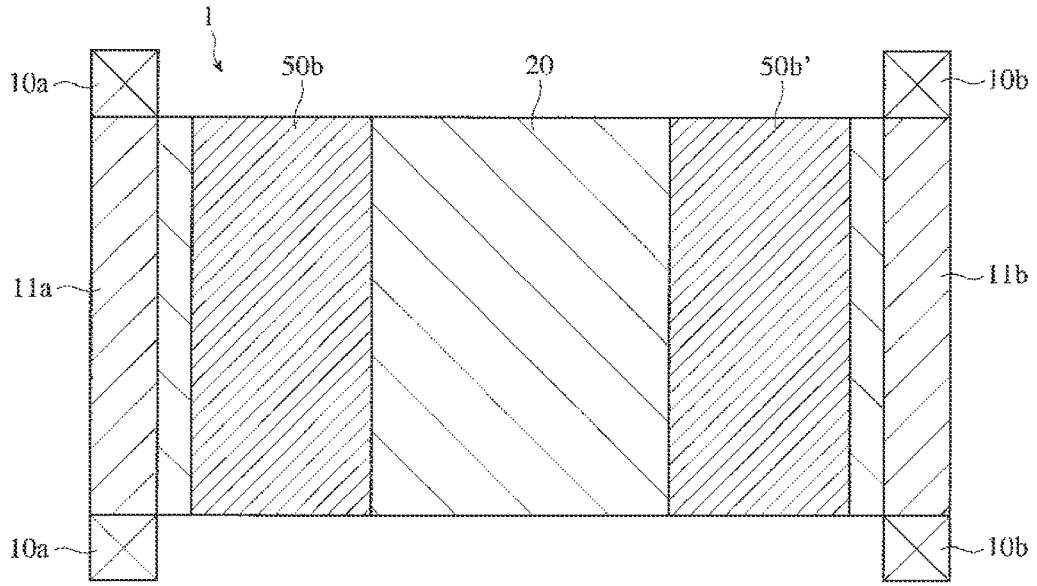
Figure 4:
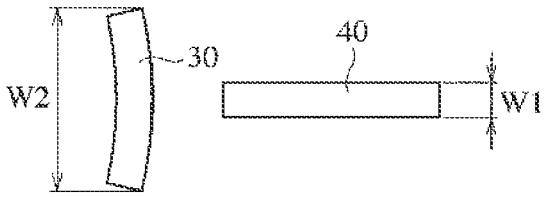
FIG. 4 is a schematic view showing the positional relation between a cavity and a central ferromagnetic body.

The arcuate magnet having polar-anisotropic orientation is formed in a magnetic field by a die apparatus shown in FIGS. 2(*a*)-2(*c*). The die apparatus 1 comprises a die 20 made of non-magnetic cemented carbide, which is disposed in a parallel magnetic field M formed by a pair of opposing magnetic field coils 10*a*, 10*b* and coil cores 11*a*, 11*b*, an arcuate-cross-sectional cavity 30 having an inner arcuate wall 31, an outer arcuate wall 32 and two side walls 33*a*, 33*b* and formed in the die 20; a central ferromagnetic body 40 arranged on the side of the outer arcuate wall 32 of the cavity 30 with distance from the cavity 30; and a pair of side ferromagnetic bodies 50*a*, 50*b* symmetrically disposed on both sides of the side walls 33*a*, 33*b* of the cavity 30 with distance from the cavity 30. The cavity 30 is arranged such that its radial direction D at a circumferential center is parallel with the direction of the parallel magnetic field M. The central ferromagnetic body 40 has a width W1 smaller than the width W2 of the cavity 30, in a direction perpendicular to the parallel magnetic field M when viewed from above (see FIG. 4). A pair of the side ferromagnetic bodies 50*a*, 50*b* are arranged such that the cavity 30 is included in a region S1 sandwiched by a pair of the side ferromagnetic bodies 50*a*, 50*b* [see FIG. 5(*a*)]. The coil core 11*a* may be in contact with the side ferromagnetic bodies 50*a*, 50*b*.

The die apparatus of the present invention has a structure comprising at least one arcuate-cross-sectional cavity 30, one central ferromagnetic body 40, and a pair of side ferromagnetic bodies 50*a*, 50*b* in a parallel magnetic field M, preferably symmetrical in the A-A cross section shown in FIG. 2(*a*). Namely, it is preferable that the cavity 30 and the central ferromagnetic body 40 have symmetrical shapes in the A-A cross section, and that a pair of the side ferromagnetic bodies 50*a*, 50*b* are disposed symmetrically in the A-A cross section.

As shown in FIG. 2(*a*), another arcuate-cross-sectional cavity 30' and another pair of side ferromagnetic bodies 50*a*', 50*b*' are preferably added symmetrically with respect to a plane [shown by the chain line C in FIG. 2(*a*)] perpendicular to the parallel magnetic field M passing through a middle point of the central ferromagnetic body 40. In this case, the central ferromagnetic body 40 is preferably common to the cavities 30, 30', having a symmetrical shape with respect to the plane shown by the chain line C.

The die 20 is made of non-magnetic cemented carbide, preferably WC cemented carbide.

(2) Cavity

Figure 3A:
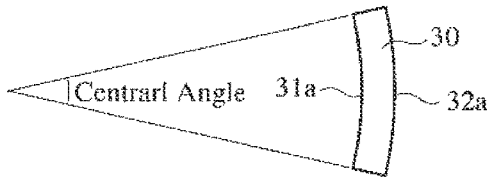
FIG. 3(*a*) is a schematic view showing one example of cross-sectional shapes of the cavity.
Figure 3B:
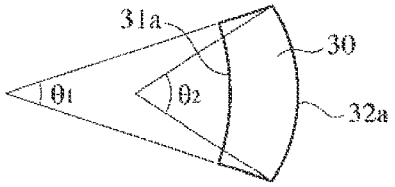

The cavity 30 preferably has such a shape that a sintered body obtained from a green body molded by the die apparatus 1 comprising the cavity 30 has a shape near the shape of a segment cut out of the ring magnet. In the cross-sectional shape of the cavity 30, the central angle and center point of an inner arc and an outer arc corresponding to the inner arcuate wall 31 and outer arcuate wall 32 of the cavity 30 are properly set within the present invention to provide a sintered body having a target shape, taking into consideration the sintering deformation of a green body. In the cross section of the cavity 30, the radii of the inner arcuate and the outer arcuate may be set depending on the applications of arcuate magnets formed. Taking into consideration the applications and shapes of the arcuate magnets, the outer arc may have a larger or smaller radius than that of the inner arc. FIGS. 3(*a*) and 3(*b*) show examples of the cross sections of a cavity for forming the arcuate magnet. The cavity shown in FIG. 3(*a*) is an example in which the inner arc 31*a* and the outer arc 32*a* have the same central angle with a common center point, and the cavity shown in FIG. 3(*b*) is another example in which the inner arc 31*a* and the outer arc 32*a* have different central angles $\theta_1$ and $\theta_2$, and different positions of their center points.

As shown in FIG. 2(*b*), the cavity 30 has an arcuate cross section comprising a lower punch 60 and an upper punch 70, the upper punch 70 being detachable from the cavity 30. In a parallel magnetic field M generated by a magnetic field coils 10*a*, 10*b* with cores 11*a*, 11*b*, magnetic powder charged into the cavity 30 is compression-molded by the lower punch 60 and the upper punch 70 in a direction perpendicular to the parallel magnetic field M, to form a green body.

Figure 6A:
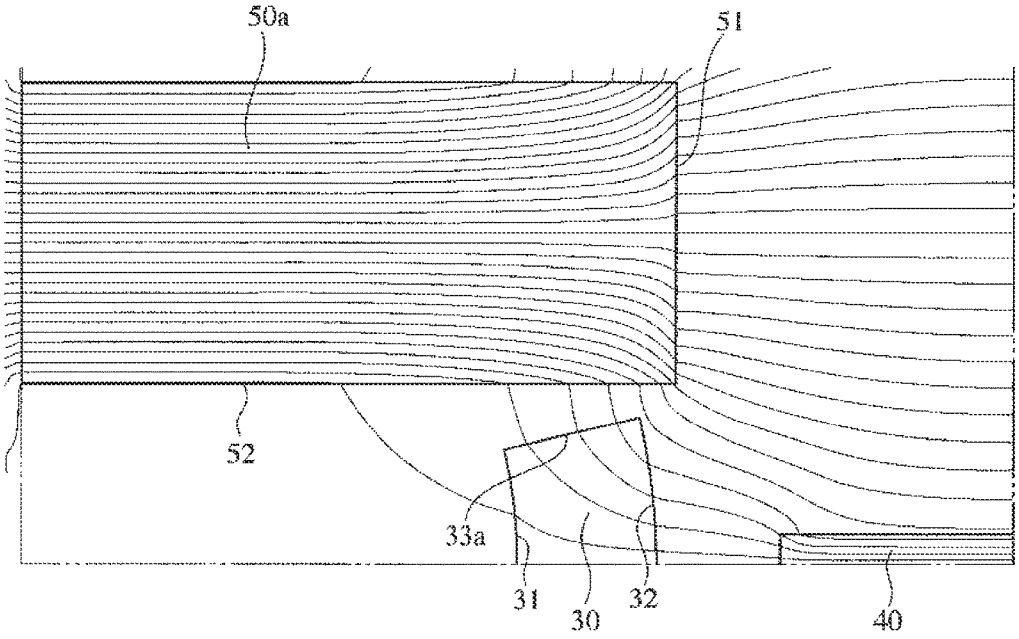
FIG. 6(*a*) is a schematic view showing one example of parallel magnetic fields applied in the die apparatus.
Figure 6B:
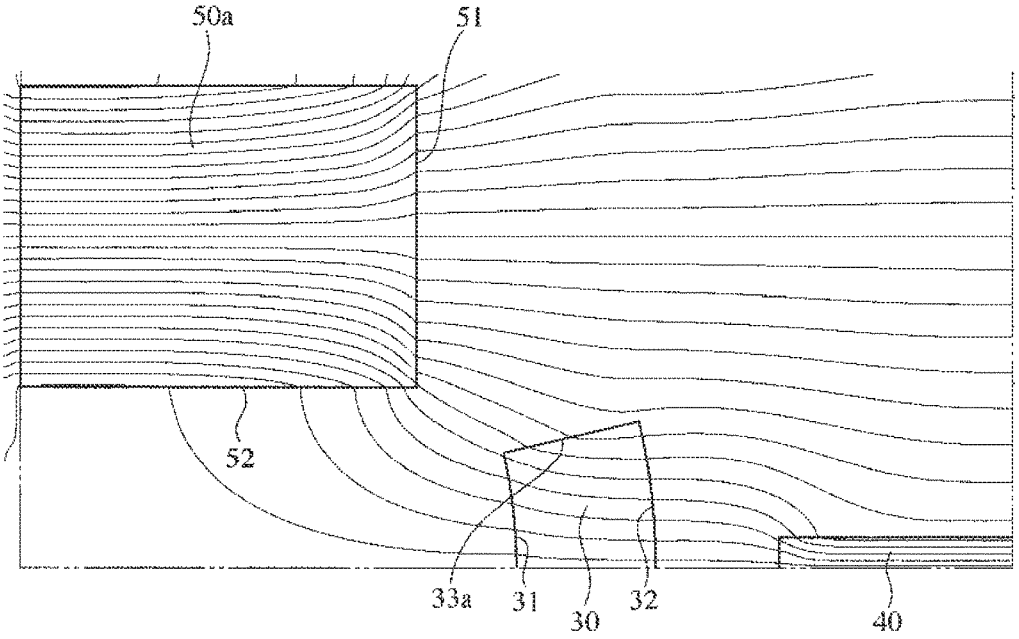

The direction of a magnetic field passing through the cavity during molding will be explained below. FIG. 6(*a*) enlargedly shows a magnetic field in a region R encircled by a two-dot chain line in FIG. 2(*a*), when a parallel magnetic field is applied. As shown in FIG. 6(*a*), a magnetic field generated by the magnetic field coils 10*a*, 10*b* is converged in the side ferromagnetic body 50*a*, and most of the converged magnetic field exits from an end surface 51 of the side ferromagnetic body 50*a*. However, part of the magnetic field exits from a side surface 52 of the side ferromagnetic body 50*a*, enters the cavity 30 through its side wall 33*a* substantially perpendicularly thereto, passes through the magnetic powder in the cavity 30 while orienting the magnetic powder, exits from a near-center portion of the outer arcuate wall 32 of the cavity 30, and passes through the central ferromagnetic body 40. Because the magnetic field emanating from the side surface 52 of the side ferromagnetic body 50*a* enters the cavity 30 through the side wall 33*a* substantially perpendicularly, an arcuate magnet molded in a magnetic field in this die apparatus 1 has orientation, which is close to the orientation of the ring-shaped, polar-anisotropic magnet between magnetic poles.

(3) Central Ferromagnetic Body and Side Ferromagnetic Bodies

Though the side ferromagnetic bodies 50*a*, 50*b* and the central ferromagnetic body 40 may have any shapes as long as the direction of a magnetic field can be controlled as described above, their shapes are preferably quadrilateral, more preferably rectangular, when viewed from above, as shown in FIG. 2(*a*). Rectangular shapes make it easy to machine the side ferromagnetic bodies 50*a*, 50*b* and the central ferromagnetic body 40, and to provide the non-magnetic cemented carbide die with holes for receiving them. In addition, the rectangular shapes are advantageous in strength.

With the width W1 of the central ferromagnetic body 40 smaller than the width W2 of the cavity 30 in a direction perpendicular to the parallel magnetic field M when viewed from above, as shown in FIGS. 2(*a*) and 4, a magnetic field concentratively flows from a center portion of the outer arcuate wall 32 of the cavity 30, thereby providing the molded arcuate magnet with close orientation to the orientation between magnetic poles of the ring-shaped, polar-anisotropic magnet. The preferred range of the width W1 is 10-30% of the width W2.

The central ferromagnetic body 40 is arranged on a radial-direction line passing through a circumferential middle point of the cavity 30 with distance from the cavity 30, when viewed from above. The central ferromagnetic body 40 preferably has a symmetrical shape with respect to this line. By the central ferromagnetic body 40 having the above shape and thus arranged, a magnetic field at a circumferential center of the cavity 30 has the same direction as that of the parallel magnetic field M, making it possible to produce an arcuate magnet comprising magnetic powder oriented in a radial direction at a circumferential center of the outer arcuate surface. A smaller distance between the central ferromagnetic body 40 and an arcuate center portion of the cavity provides the resultant magnet with a thinner surface magnetic flux density relative to a sinusoidal wave, and a larger distance provides a surface magnetic flux density bulged from a sinusoidal wave.

Figure 5A:
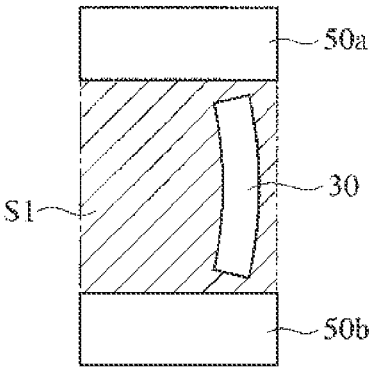
FIG. 5(*a*) is a schematic view showing one example of the positional relations between a cavity and a side ferromagnetic body.
Figure 5B:
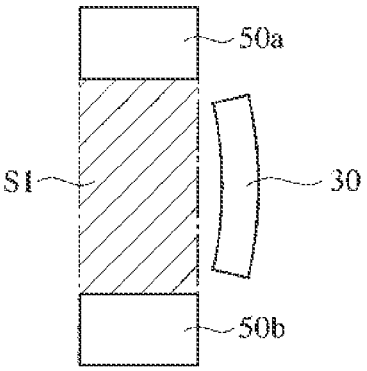

With a pair of the side ferromagnetic bodies 50*a*, 50*b* arranged such that the cavity 30 is positioned in a region S1 sandwiched by a pair of them as shown in FIG. 5(*a*), a magnetic field emanating from the side surface 52 of the side ferromagnetic body 50*a* can be controlled to enter the cavity 30 substantially perpendicularly to its side wall 33*a* as shown in FIG. 6(*a*). However, for example, when the cavity 30 is not positioned in a region S1 sandwiched by a pair of the side ferromagnetic bodies 50*a*, 50*b* as shown in FIG. 5(*b*), a magnetic field emanating from the side surface 52 of the side ferromagnetic body 50*a* does not enter the cavity 30 through its side wall 33*a* but through its inner arcuate wall 31, and a magnetic field emanating from the end surface 51 of the side ferromagnetic body 50*a* enters the cavity 30 through its side wall 33*a* slantingly, as shown in FIG. 6(*b*), failing to obtain an arcuate magnet comprising magnetic powder perpendicularly oriented at a circumferential end surface.

The cavity 30 is desirably as close to the side ferromagnetic bodies 50*a*, 50*b* as possible. Larger distance therebetween undesirably tends to make a surface magnetic flux density wave on the arcuate magnet bulge from a sinusoidal wave.

It is noted, however, that there should be some gaps between the central ferromagnetic body 40 and the cavity 30, and between the side ferromagnetic bodies 50*a*, 50*b* and the cavity 30, from the aspect of the strength of the die apparatus 1. Because the ferromagnetic bodies generally have low strength, narrow gaps with the cavity 30 lead to the deformation of the die by compression molding, resulting in cracking in the ferromagnetic bodies. Accordingly, there should be a sufficient distance between these magnetic bodies and the cavity 30, to such an extent that the cemented carbide die is not deformed by stress during pressing.

Figure 7A:
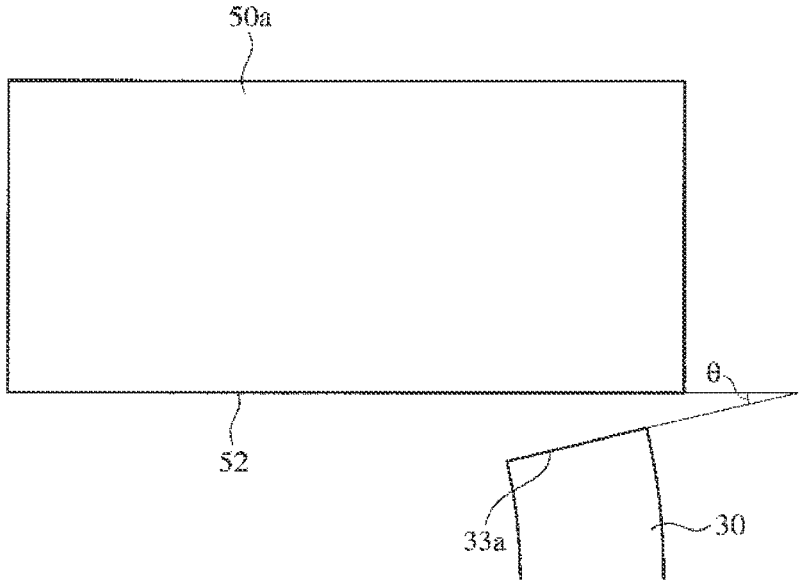
FIG. 7(*a*) is a schematic view showing one example of the relations between opposing surfaces of a cavity and a side ferromagnetic body.
Figure 7B:
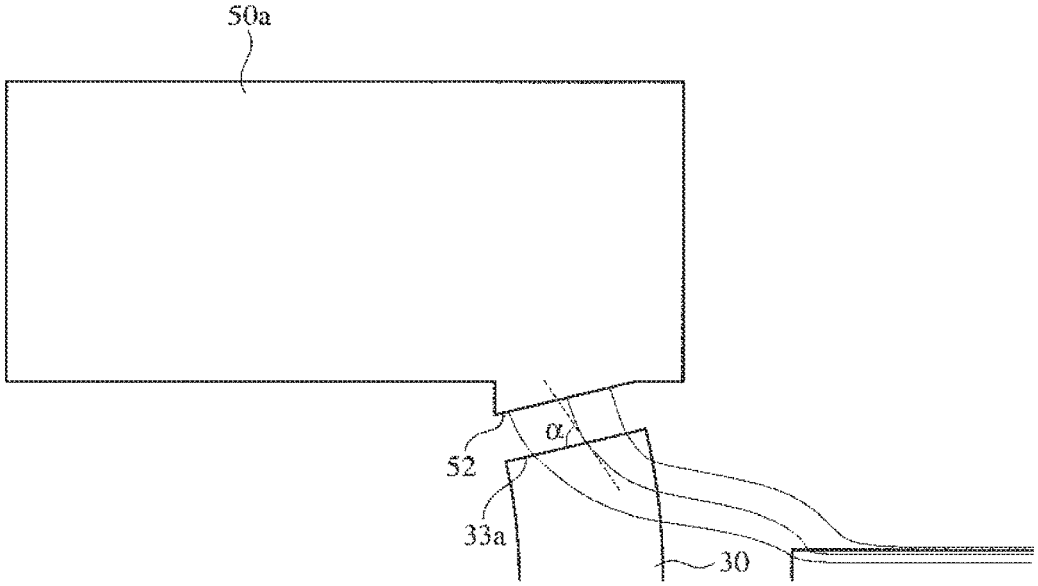

An angle θ between the side wall 33*a* of the cavity 30 and the side surface 52 of the side ferromagnetic body 50*a* [see FIG. 7(*a*)] is preferably $0 \leq \theta$. Because the direction of a magnetic field entering the side wall 33*a* of the cavity 30, which emanates from the side surface 52 of the side ferromagnetic body 50*a*, can be controlled to some extent by changing the intensity of the magnetic field, a magnetic field emanating from the side surface 52 of the side ferromagnetic body 50*a* can be caused to enter the side wall 33*a* of the cavity 30 substantially perpendicularly, when the angle θ meets the condition of $0 \leq \theta$ as shown in FIG. 6(*a*).

When the side wall 33*a* of the cavity 30 and the side surface 52 of the side ferromagnetic body 50*a* are parallel ($\theta=0$) as shown in FIG. 7(*b*), a magnetic field emanating from the side surface 52 of the side ferromagnetic body 50*a* already has a component in the direction of the parallel magnetic field, so that it enters the side wall 33*a* of the cavity 30 at an angle α (<90°), with a vector toward the central ferromagnetic body 40 added until reaching the side wall 33*a* of the cavity 30. In this case, even if the intensity of the magnetic field were changed, it would be impossible to cause a magnetic field emanating from the side surface 52 of the side ferromagnetic body 50*a* to enter the side wall 33*a* of the cavity 30 completely perpendicularly.

The shape and arrangement of the side ferromagnetic body 50*a* are preferably selected such that the angle θ is larger than 0°. With the side ferromagnetic body 50*a* thus selected, a component of the magnetic field in the direction of the parallel magnetic field can be made small when emanating from the side surface 52 of the side ferromagnetic body 50*a*, so that the magnetic field emanating from the side surface 52 of the side ferromagnetic body 50*a* can be caused to enter the side wall 33*a* of the cavity 30 perpendicularly, even though a vector in the direction of the central ferromagnetic body 40 is added. The upper limit of θ is preferably 50° ($\theta \leq 50°$).

General magnetic materials may be used for the central ferromagnetic body 40 and the side ferromagnetic bodies 50*a*, 50*b*, and S45C, magnetic cemented carbide, etc. are particularly suitable.

[3] Production Method (1) Preparation of Magnetic Powder

The pulverization of magnetic powder preferably comprises coarse pulverization and fine pulverization. The coarse pulverization is conducted preferably by a stamp mill, a jaw crusher, a Brown mill, a disc mill, hydrogen pulverization, etc., and the fine pulverization is conducted preferably by a jet mill, a vibration mill, a ball mill, etc. In any case, to prevent oxidation, it is preferably conducted in a non-oxidizing atmosphere using an organic solvent or an inert gas. The particle sizes of pulverized powder are preferably 2-8 μm (FSSS). Magnetic powder of less than 2 μm has so high activity that it is vigorously oxidized, resulting in large sintering deformation and poor magnetic properties. Magnetic powder of more than 8 μm provides large crystal grain sizes after sintering, easily causing magnetization reversal, and thus resulting in low coercivity.

(2) Molding

The intensity of a parallel magnetic field applied to the cavity 30 for achieving the orientation of magnetic powder is preferably 159 kA/m or more, more preferably 239 kA/m or more. When the intensity of an orienting magnetic field is less than 159 kA/m, sufficient orientation of magnetic powder is not achieved, failing to obtain good magnetic properties. The intensity of an orienting magnetic field is properly determined, taking into consideration the polar-anisotropic orientation of an arcuate magnet obtained at more than the above magnetic field intensity. The molding pressure is desirably 0.5-2 ton/cm$^2$. Less than 0.5 ton/cm$^2$ of the molding pressure provides weak green bodies which are easily broken, and more than 2 ton/cm$^2$ of the molding pressure disturbs the orientation of magnetic powder, resulting in low magnetic properties.

(3) Sintering

The sintering is conducted preferably at 1000-1150° C. in vacuum or in an argon atmosphere. At lower than 1000° C., the sintering is insufficient, failing to obtain a necessary density, and thus resulting in low magnetic properties. At higher than 1150° C., excessive sintering occurs, resulting in deformation and low magnetic properties.

The sintering is conducted on a green body placed in a Mo plate in a heat-resistant container made of Mo. In the case of a rolled Mo plate having small surface roughness, the sintered body is easily stuck to the Mo plate, and the sintered magnet is likely deformed by sintering shrinkage. To prevent the sintered body from sticking to the Mo plate, the Mo plate is provided with surface roughness increased by machining, etc., thereby reducing its contact surface area with the green body. The machining is preferably blasting. The blasted Mo plate has surface roughness (JIS R6001-1983) of preferably 5-100 μm, more preferably 7-50 μm, most preferably 10-30 μm as Rmax. With the surface roughness of less than 5 μm, the sintered body is easily stuck to the Mo plate, resulting in the deformation of sintered magnets. With the surface roughness of more than 100 μm, the sintered body is deformed by engaging a shrinking Mo plate. The Mo plate may be coated with neodymium oxide, etc. to prevent the sintered body from sticking to the Mo plate.

(4) Other Steps

The resultant sintered body is preferably heat-treated. The heat treatment may be conducted before or after machining described later.

The outer arcuate surface, inner arcuate surface and end surfaces of the sintered body are preferably machined to required sizes, if necessary. Machining may be conducted by properly using an existing apparatus such as an outer-surface grinder, an inner-surface grinder, a flat surface grinder or contour grinder, etc. Surface treatments such as plating, coating, the vacuum deposition of aluminum, chemical coating, etc. may be conducted if necessary.

Figure 9:
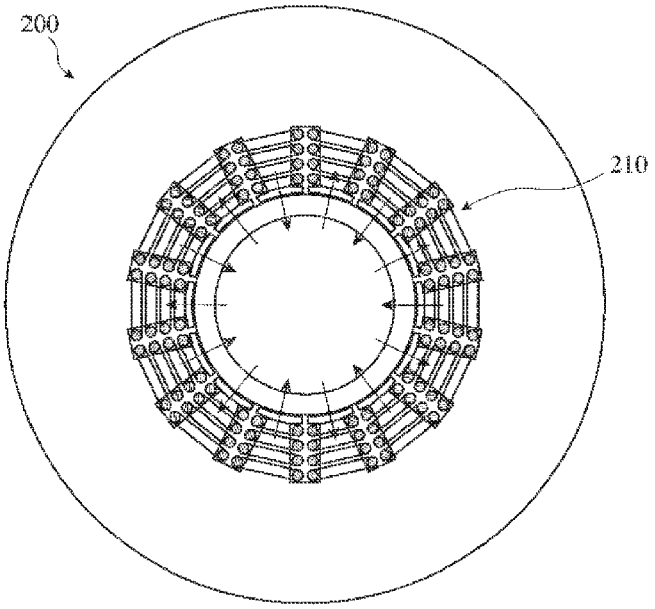
FIG. 9 is a schematic view showing a magnetizing yoke comprising 14 coils each providing a magnetic pole.
Figure 10:
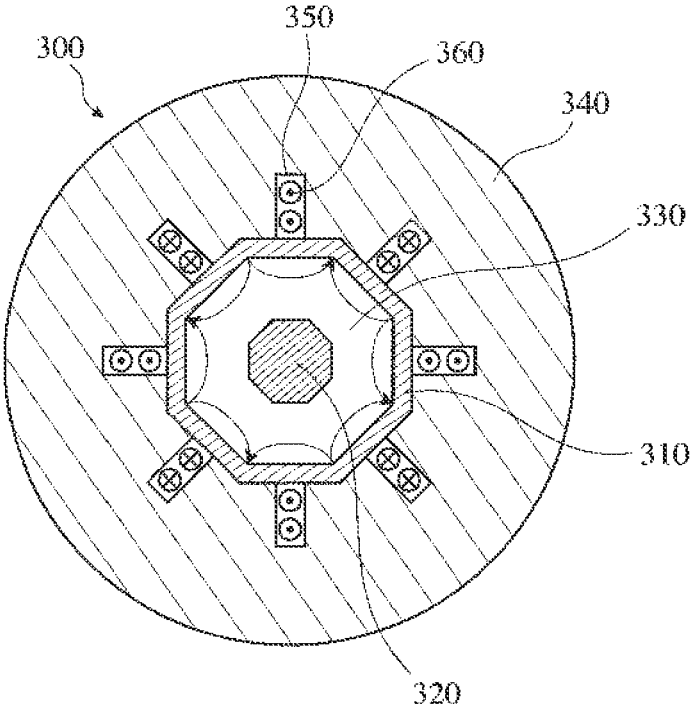
FIG. 10 is a schematic view showing a die apparatus for molding a ring magnet having polar-anisotropic orientation in a magnetic field.

The arcuate magnets having polar-anisotropic orientation are bonded to a rotor yoke by an adhesive to produce a rotor for a brushless motor. Each arcuate magnet 120 bonded to the rotor for a brushless motor is magnetized, for example, by a magnetizing yoke 200 comprising coils 210 as shown in FIG. 9, in which the arrows indicate the directions of a magnetic field applied for magnetization. The magnetization conditions are preferably capacitance of 1000-2000 μF, charging voltage of 1000-2500 V and magnetization current of 8-25 kVA. The magnetization current of less than 8 kVA cannot provide desired magnetic properties by magnetization, and magnetization at more than 25 kVA fails to provide further improvement in magnetic properties.

The method of the present invention can be applicable to both of dry molding and wet molding. It is also applicable to ferrite magnets, Sm—Co magnets, and resin-bonded magnets.

The present invention will be explained in more detail referring to Examples below, without intention of restricting the present invention thereto.

Example 1

A Nd—Fe—B magnet powder having a composition comprising 20.5% by mass of Nd, 6.2% by mass of Dy, 5.5% by mass of Pr, and 1.0% by mass of B, the balance being Fe and inevitable impurities, was produced by a known method. The resultant magnetic powder was charged into an arcuate-cross-sectional cavity (a radius of an outer arc: 50 mm, a radius of an inner arc: 37 mm, and a central angle: 25.7°) in the die apparatus shown in FIGS. 2(*a*)-2(*c*). The side ferromagnetic bodies used have the shape shown in FIG. 7(*a*). With a parallel magnetic field of 239-319 kA/m applied to the die apparatus along the radial direction of the cavity at its circumferential center, the magnetic powder was molded at a molding pressure of 1 t/cm$^2$. The resultant green body was sintered, heat-treated, and then machined to obtain an arcuate sintered magnet with an outer arc radius of 80 mm, an inner arc radius of 64 mm, and a central angle of 25.7°.

Example 2

An arcuate sintered magnet was produced in the same manner as in Example 1 except for changing the shape of the side ferromagnetic bodies as shown in FIG. 7(*b*).

Example 3

An arcuate sintered magnet was produced in the same manner as in Example 1, except that the arrangement the central ferromagnetic body, the side ferromagnetic bodies and the cavity was changed, such that a sintered magnet had a surface magnetic flux density wave closer to a sinusoidal wave.

Comparative Example

An arcuate sintered magnet was produced in the same manner as in Example 1, except that the central ferromagnetic body and the side ferromagnetic bodies were not used at all.

Reference Example

Magnetic powder produced by the same method as in Example 1 was molded by an existing die apparatus for molding a ring magnet having polar-anisotropic orientation, which had 14 magnetic poles on the periphery, an outer diameter of 100 mm, and an inner diameter of 74 mm, sintered and then heat-treated. The sintered body was machined to an outer diameter of 80 mm and an inner diameter of 64 mm, to obtain a ring magnet having polar-anisotropic orientation. The molding was conducted by the method described in JP 59-216453 A.

Figure 8:
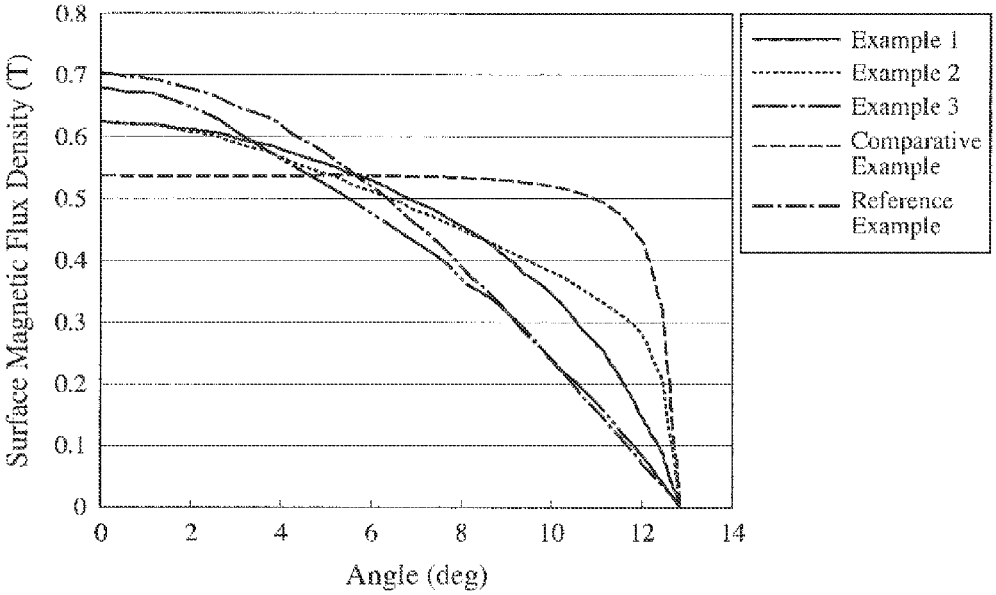
FIG. 8 is a graph showing the surface magnetic flux density waves of the sintered magnets of Examples 1-3, Reference Example and Comparative Example.

In each of Examples 1-3 and Comparative Example, the arcuate sintered magnets were bonded to a cylindrical yoke to a ring shape. In Reference Example, a cylindrical yoke was inserted into the ring magnet. Each of the magnets was magnetized to have 14 magnetic poles, using a magnetizing yoke 200 comprising 14 coils 210 each for a magnetic pole as shown in FIG. 9, in which the arrows indicate the directions of a magnetic field applied for magnetization, and measured with respect to a surface magnetic flux density wave. The results are shown in FIG. 8. FIG. 8 shows a waveform corresponding to a half of a magnetic pole among 14 magnetic poles.

As is clear from FIG. 8, while the arcuate sintered magnets of Comparative Example had a nearly trapezoidal waveform, the arcuate sintered magnets of Examples 1-3 had waveforms close to that of the polar-anisotropic ring magnet of Reference Example. The surface magnetic flux density wave of the arcuate sintered magnet of Example 2 produced by using the side ferromagnetic bodies having the shape shown in FIG. 7(*b*) was slightly bulged between magnetic poles than that of Example 1. The arcuate sintered magnet of Example 3 had a waveform substantially identical to that of the polar-anisotropic ring magnet of Reference Example, indicating ideal polar-anisotropic orientation.

While a high cogging torque is expected in rotors formed by the sintered magnets of Comparative Example, a low cogging torque is expected in rotors formed by the sintered magnets of Examples 1-3 within the present invention.

EFFECTS OF THE INVENTION

Because the arcuate magnet of the present invention has ideal polar-anisotropic orientation, a ring magnet obtained by assembling them has a surface magnetic flux density distribution in a circumferential direction, which has a waveform close to a sinusoidal waveform. Accordingly, the use of such arcuate magnets for a rotor provides a motor having a low cogging torque, which is suitable as a brushless motor. The die apparatus of the present invention can produce arcuate magnets having ideal polar-anisotropic orientation.

What is claimed is:

1. A die apparatus for molding an arcuate magnet having polar-anisotropic orientation in a magnetic field, which comprises a die made of non-magnetic cemented carbide, which is arranged in a parallel magnetic field generated by a pair of opposing magnetic field coils;

an arcuate-cross-sectional cavity having an inner arcuate wall, an outer arcuate wall and two side walls, which is disposed in said die, wherein the inner arcuate wall has a length which is shorter than that of the outer arcuate wall;

a central ferromagnetic body arranged on the side of the outer arcuate wall of said cavity with distance from said cavity; and a pair of side ferromagnetic bodies symmetrically arranged on both side wall sides of said cavity with distance from said cavity;

said cavity being arranged such that its radial direction at a circumferential center thereof is identical with the direction of said parallel magnetic field;

the width of said central ferromagnetic body being smaller than the width of said cavity in a direction perpendicular to said parallel magnetic field, when viewed from above; and a pair of said side ferromagnetic bodies being arranged such that said cavity is positioned in a region sandwiched by facing surfaces of a pair of said side ferromagnetic bodies.

2. The die apparatus according to claim 1, wherein said central ferromagnetic body is arranged on a radial-direction line passing through a circumferential middle point of said cavity, and has a symmetrical shape with respect to said line, when viewed from above.

3. The die apparatus according to claim 2, wherein said central ferromagnetic body has a symmetrical shape with respect to a plane, which passes through a middle point of said central ferromagnetic body in the direction of said magnetic field and is perpendicular to the direction of said magnetic field; and wherein another cavity and another pair of side ferromagnetic bodies are arranged symmetrically with respect to said plane.

4. The die apparatus according to claim 3, wherein said central ferromagnetic body and/or said side ferromagnetic bodies are rectangular when viewed from above.

5. The die apparatus according to claim 4, wherein an angle between each side wall of said cavity and a surface of each of said side ferromagnetic bodies opposing said side wall is more than 0°.

6. The die apparatus according to claim 3, wherein an angle between each side wall of said cavity and a surface of each of said side ferromagnetic bodies opposing said side wall is more than 0°.

7. The die apparatus according to claim 2, wherein said central ferromagnetic body and/or said side ferromagnetic bodies are rectangular when viewed from above.

8. The die apparatus according to claim 7, wherein an angle between each side wall of said cavity and a surface of each of said side ferromagnetic bodies opposing said side wall is more than 0°.

9. The die apparatus according to claim 2, wherein an angle between each side wall of said cavity and a surface of each of said side ferromagnetic bodies opposing said side wall is more than 0°.

10. The die apparatus according to claim 1, wherein said central ferromagnetic body has a symmetrical shape with respect to a plane, which passes through a middle point of said central ferromagnetic body in the direction of said magnetic field and is perpendicular to the direction of said magnetic field; and wherein another cavity and another pair of side ferromagnetic bodies are arranged symmetrically with respect to said plane.

11. The die apparatus according to claim 10, wherein said central ferromagnetic body and/or said side ferromagnetic bodies are rectangular when viewed from above.

12. The die apparatus according to claim 11, wherein an angle between each side wall of said cavity and a surface of each of said side ferromagnetic bodies opposing said side wall is more than 0°.

13. The die apparatus according to claim 10, wherein an angle between each side wall of said cavity and a surface of each of said side ferromagnetic bodies opposing said side wall is more than 0°.

14. The die apparatus according to claim 1, wherein said central ferromagnetic body and/or said side ferromagnetic bodies are rectangular when viewed from above.

15. The die apparatus according to claim 14, wherein an angle between each side wall of said cavity and a surface of each of said side ferromagnetic bodies opposing said side wall is more than 0°.

16. The die apparatus according to claim 1, wherein an angle between each side wall of said cavity and a surface of each of said side ferromagnetic bodies opposing said side wall is more than 0°.

17. A method for producing an arcuate magnet having polar-anisotropic orientation, comprising molding magnetic powder with a die apparatus comprising a die made of non-magnetic cemented carbide, which is arranged in a parallel magnetic field generated by a pair of opposing magnetic field coils;

an arcuate-cross-sectional cavity having an inner arcuate wall, an outer arcuate wall and two side walls, which is disposed in said die, wherein the inner arcuate wall has a length which is shorter than that of the outer arcuate wall;

a central ferromagnetic body arranged on the side of the outer arcuate wall of said cavity with distance from said cavity; and a pair of side ferromagnetic bodies symmetrically arranged on both side wall sides of said cavity with distance from said cavity;

said cavity being arranged such that its radial direction at a circumferential center thereof is identical with the direction of said parallel magnetic field;

the width of said central ferromagnetic body being smaller than the width of said cavity in a direction perpendicular to said parallel magnetic field, when viewed from above; and a pair of said side ferromagnetic bodies being arranged such that said cavity is positioned in a region sandwiched by facing surfaces of a pair of said side ferromagnetic bodies;

said magnetic powder charged into said cavity being compression-molded in said parallel magnetic field.

18. The method according to claim 17, wherein said magnetic powder comprises an R-TM-B alloy, wherein R is at least one of rare earth elements including Y, and TM is at least one of transition metals.

19. An arcuate magnet having polar-anisotropic orientation, which is produced by the method recited in claim 17.

* * * * *